US005189976A

United States Patent [19]

Cochran et al.

[11] Patent Number: 5,189,976

[45] Date of Patent: Mar. 2, 1993

[54] SAIL SHAPING ARRANGEMENT FOR SAILBOARDS

[76] Inventors: Steven M. Cochran, 2350 N. Woodward Ave., No. 5, Bloomfield, Mich. 48013; Mark J. Murphy, 1228 Oakwood Ct., Rochester, Mich. 48063

[21] Appl. No.: 656,732

[22] Filed: Feb. 19, 1991

[51] Int. Cl.[5] ..... A63H 9/08

[52] U.S. Cl. ..... 114/102; 114/39.2

[58] Field of Search ..... 114/102, 103, 39.2

[56] References Cited

U.S. PATENT DOCUMENTS 4,733,624 3/1988 Belvedere ..... 114/103
4,924,793 5/1990 Pritchard ..... 114/102

FOREIGN PATENT DOCUMENTS 3504592 12/1986 Fed. Rep. of Germany ..... 114/103
8400538 9/1985 Netherlands ..... 114/102
85/04377 10/1985 World Int. Prop. O. ..... 114/102

*Primary Examiner*—Sherman Basinger
*Assistant Examiner*—Thomas J. Brahan
*Attorney, Agent, or Firm*—John R. Benefiel

[57] ABSTRACT

A sail shaping arrangement for a sailing craft as a sailboard is described, the arrangement associated with each of the sail battens. The shaping arrangement includes a pair of flexible fingers extending over and past each batten to straddle the mast within the mast sleeve. As the sail swifts to either leeward position, one end of the windward finger is bent to form a knee, one side of the bent end acting against the mast to be restrained thereby stabilizing the sail in that condition and also tenching to arch the batten and thus act as a camber inducer. The flexible fingers are preferably flat plastic pieces installed in pockets sewn opposite each other onto either side of the sail over the batten pockets.

10 Claims, 3 Drawing Sheets

SAIL SHAPING ARRANGEMENT FOR SAILBOARDS

FIELD OF THE INVENTION

This invention concerns sailing craft and more particularly sail shaping and stabilizing arrangements for the sail of a sailboard.

BACKGROUND OF THE INVENTION

Sailboards are rigged with a sail extending from a mast mounted on the flat board or platform hull, with a universal joint connection between the platform and mast allowing trim manipulation of the sail by a rider standing on the platform grasping a wishbone shaped boom attached to the mast and extending on either side of the sail. The sail is tensioned with an outhaul tackle attached to the clew of the sail and the outer end of the boom.

Sailboard sails are generally triangular in outline. The sail generally has a mast sleeve which is closed at the head and open at the foot, and is rigged by inserting the mast into the sleeve. Downhaul tackle, just above the universal joint, secures the tack and allows adjustment of luff tension. The wishbone boom attaches to the mast at mid-height through a cutout in the sleeve. The rider controls the board's direction by tilting the boom forward or aft and its velocity by sheeting the sail in or out. He balances the aerodynamic forces of the sail against the hydrodynamic ones of the platform hull and fin by movement of the boom, positioning his weight and controlling the thrust line of his body.

In spite of the apparent simplicity of the sailboard's rig, the lack of external tackle or standing rigging makes it one of the purest expressions of applied aerodynamics. Since the rider's total reactive force is limited, high performance sails must have a good lift/drag ratio, a low center of effort and predictable handling characteristics over a wide range of wind speeds. Predictable handling results from the maintenance of a stable sail cross-section in all wind speeds.

Presently, the two most distinct categories of sailboard sails are the "RAF" (rotating asymmetrical airfoil) and the camber induced sail. The RAF was the earlier development. In an RAF, a carefully controlled mast sleeve diameter allows a tangential positioning of the sleeve and battens on the leeward side of the mast. This greatly increases the sail's efficiency by maintaining better flow attachment on the leeward surface of the foil. Wind tunnel tests have shown that the tangential position of the sail relative to the mast produce substantial lift/drag improvements over a conventional inline arrangement of mast and sail.

The term "sail rotation" is used to describe the motion of battens and mast sleeve around the mast's centerline. In order to maintain a preload in the sailcloth when the sail is rigged, the sail's luff curve is cut to match the mast bend for a similar loading. The sail is laid up of several panels as if covering an airfoil form. The abutting edges of the panels are curved convexly to fit this spherical surface. This panel curvature used to control the sail's three dimensional shape is described in sailmaking parlance as "broad seaming".

In spite of the RAF's improved efficiency it had two major problems: maintaining batten tangency and rotational stiffness.

Batten tangency problems result either from a mismatch of mast and mast sleeve diameter or that the mast's bending curve was not matched to the sail design. As a result of a misfit, the sleeve might be too tight, not allowing complete rotation of the battens to the mast tangency point. Or it could be too loose, allowing over rotation and permitting the battens to project forward of the tangency point. Over rotation also resulted from trying to rig the sail on too stiff a mast. In this case the excess luff round pushes the battens beyond the mast when downhaul tension is applied. Over rotation forms a ridge, interrupting smooth flow onto the sail. Either over or under rotation significantly reduces the sails aerodynamic efficiency.

The ideal sailboard sail has high rotational stiffness, allowing the sail to be depowered by reducing its angle of attack. If the cross-section is stable, this allows reduction of the lift coefficient without changing the moment characteristics of the foil. However, if the rotational stiffness of the joint formed by the mast sleeve and the sail body is low, the sail will easily rotate to an inline position. The three dimensional surface of the sail is only stable at the mast tangency points. Movement to an inline position will destabilize the cross-section. So, as the rider tries to depower an RAF, or the sail tension increases in a strong gust, the sail derotates, permitting the leading edge to cave in and the draft to move aft, generating a large pitching moment.

Unlike a boat, with a fixed mast and stays, the sail forces of a windsurfer must all be resisted by the rider. Straight vector resolution isn't a problem but a moment is. Most air-foils develop some negative overturning moment (pitching moment). In general, a forward position of the maximum camber, and a straight foil section aft produce the lowest pitching moment. In an RAF the only forces available to resist rearward movement of the draft are its three dimensional panel shaping and the rigidity of the battens.

Camber reduction also reduces the lift coefficient. As the windspeed increases, the only viable option with an RAF is to increase the outhaul tension reducing the camber. Unfortunately, the resulting foils are difficult to control, since flatter sections have very abrupt stall characteristics.

Some improvement in draft control has been achieved by the use of lightweight tapered battens. Under compressive load, they bend in their forward third and are extremely stiff toward the leech. The larger leading edge curvature generated by these battens also reduces the severity of the RAF sleeve tangency problem but still cannot increase sleeve tension or rotational stiffness. So, in spite of these improvements, it has been clear that greater rotational stiffness, higher fabric tension and better draft stability are required to achieve predictable performance at higher wind speeds.

To address the RAF's deficiencies a new class of devices has been developed, here referred to generically as "camber inducers". These devices attempt to solve the aerodynamic streamlining, batten curvature and luff fabric tension problems simultaneously.

In an RAF, the end of the batten pockets defines the furthest forward point of the tensile load imparted to the sail. Since the batten does not thrust against the mast, the only tension in the mast sleeve is the vertical transmission of downhaul tension and a horizontal component derived from outhaul tension and sail loading. Camber inducers react the compressive load of the battens through an intermediate member to the mast.

Although there are differences in their construction the operational characteristics of all of the camber inducers allows simultaneous tensioning of both the mast sleeve and sail body fabric all the way to the front of the mast. With this arrangement of force resolution, the fabric tension, including sleeve tension, is controlled by batten compression. The uniformity of fabric tension in the sail body is determined by the accuracy of its surface development and the local curvature of the battens. Draft is controlled by outhaul tension and the downhaul tension controls the curvature of the leading edge. Inducers also define the sail to mast tangency condition and directly increases bi-stable, rotational stiffness as a function of batten compression.

The camber inducers described in Nishimura U.S. Pat. No. 4,625,671, Magnan U.S. Pat. No. 4,686,921, Magnan, U.S. Pat. No. 4,708,079 and Magnan U.S. Pat. No. 4,856,447, are all mechanically equivalent to end loaded, loose jointed, toggle linkages. The differences between them are in the details of the hinge arrangement, mast sleeve support surfaces and batten retention within the inducer. Belvedere, U.S. Pat. Nos. 4,649,848 and 4,733,624 are actually a conformal fairing, but do allow the compressive load of the batten to tension both the sleeve and body fabric of the sail by reacting the thrust load, via the anchor strap to the mast centerline.

Split battens have been developed which react the compressive load of the batten to the mast via a stirrup.

All of the camber inducers above are described as couplings, rotationally attached to the mast, and are, therefore, constrained to operate in the plane of the linkage they define, at right angles to the mast.

While camber inducers are effective in improving mast sleeve tension, rotational stiffness and defining a stable cross-section, they do have some manufacturing and usage problems. The most obvious are rigging complexity, sleeve flooding, and manufacturing cost. A more subtle one is excessive rotational stiffness if the batten load is too great or too eccentric within the inducer body.

One of the great advantages of a sailboard over other sailing craft is its rigging simplicity, allowing a sailor to make an instant decision to get on the water if the conditions are good. Since conditions change rapidly sailors frequently use more than one sail size in a given day. Any sail that takes too long to rig cuts into valuable and limited sailing time. The time consuming mast, batten and inducer alignment necessary with most internal camber inducer systems has given rise to some simplified hybrids and has also kept the RAF alive.

The mast sleeve must be designed with openings to allow insertion of the inducers. These openings can vary from mere slits to complex zippers closures. However, in all cases they add to manufacturing cost, and the multiple openings are also difficult to seal leading to sleeve flooding.

A mechanical design constraint of all of the camber inducers cited above, which operate as planar linkages, is that they must act at right angles to the mast. This isn't the optimum aerodynamic angle for the thirty to thirty-five degree sweep angles of most windsurfing rigs. With the mast raked at these angles, the battens create a series of turbulence inducing ridges along the surface of the sail that promote early flow separation. The current trend toward stiffer and lighter tubular batten sections aft, increases the height and disruptive capability of these ridges. When applied to a typical, highly curved windsurfer mast, the right angle limitation of these devices usually confines their use to the three mid-height battens. The mast head and foot have simple RAF type battens that are hoped to be influenced by the nearby camber induced ones.

The goal of all the devices described above is the definition of stable cross-sectional profile combined with high chamber. Important operational features of devices used to accomplish it are that they should be as light as possible to facilitate handling, simple to rig and robust enough to take continuing abuse without failure.

SUMMARY OF THE INVENTION

The present invention comprises an arrangement for shaping a sail of flexible sheet material and installed on a mast by a mast sleeve sewn along the luff of the sail. The shaping arrangement stabilizes or latches the sail in its filled out conditions inclined to either side of the mast and also assists in achieving a camber shape in the sail when in the latched condition. The arrangement is associated with the sail battens and includes a pair of flexible fingers mounted opposite each other to either side of the sail to extend over a batten and forwardly so as to straddle the mast. Each finger is configured and positioned so that the forward end of the inside or windward finger bends to form a knee with one side of the bent finger reacting against the mast to be restrained thereby as the sail reaches a filled out condition on either side of the mast. The forces exerted by the bent finger on the mast acts to stabilize the position of sail luff as rotation of the mast sleeve on the mast is resisted by the engagement of the knee.

At the same time, the force of the other end of the bent finger acts on the batten so as to enhance the camber of the sail.

The outer or leeward finger remains straight, and extends tangentially from the said body to the leeward side of the mast, acting as a mast fairing.

The bent inside finger is driven to be reversed and released only when the boom is shifted sufficiently to change tack so as to become the outside finger, and the opposite finger is then bent to form a knee similarly restrained by the mast, as the sail reaches the filled out condition on the opposite side of the mast.

The pairs of fingers are preferably mounted to the sail by pockets open at the middle to readily allow insertion and removal of the fingers.

The flexible fingers are themselves preferably constructed of thin plastic strips of a material such as stress relieved polypropylene able to withstand many bendings without breaking.

This sail shaping arrangement has the advantage of being simple and lightweight, and does not complicate the rigging process or require openings in the mast sleeve.

The battens may extend generally horizontally since the fingers can extend at a raked angle to the mast, eliminating the turbulence induced by right angle battens required by prior art camber inducers.

This sail shaping arrangement can be employed with all of the battens to apply the stabilizing and camber inducing effects all along the luff of the sail.

The critical fit between the mast and mast sleeve required by the "RAF" system described above is not required, and reliable operation is insured despite any variations in the mast sleeve and mast curvature.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
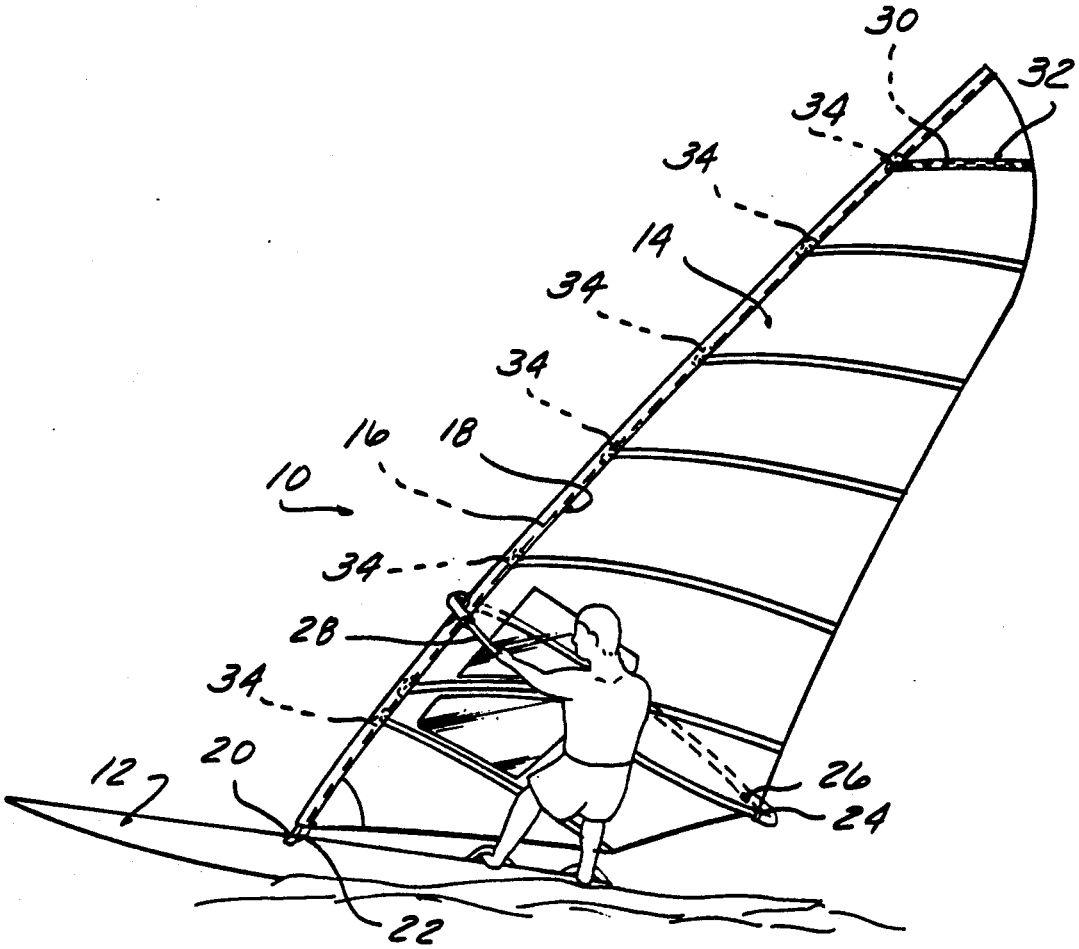
FIG. 1 is a side view of a sailboard craft equipped with a sail shaping arrangement according to the present invention.

Referring to the Drawings, and particularly FIG. 1, a sailboard sailing craft 10 is illustrated, which includes a finned hull 12 defining an upper, flat platform for a rider to stand on. A generally triangular sail 14 is rigged to a mast 16 by means of mast sleeve 18 sewn into the luff of the sail 14.

The mast 16 is mounted to the hull 12 by means of a universal joint 20 in the manner well known in the art.

The luff of the sail 14 is downwardly tensioned by a downhaul line 22 secured to the universal joint 20, and the main body of the sail is outwardly tensioned by an out haul line 24 secured at the clew 26 at a corner of the length of the sail 14 and to the rear apex of a bow shaped boom 28 surrounding the sail 14 and attached to the mast 16 in conventional fashion.

According to the present invention, a series of battens 30 are received in pockets 32 sewn across the width of the sail 14 raked at an angle to the rearwardly tilted mast 16.

A series of sail shaping arrangements 34 according to the present invention are operatively associated with the leading end of each batten 30.

Figure 2:
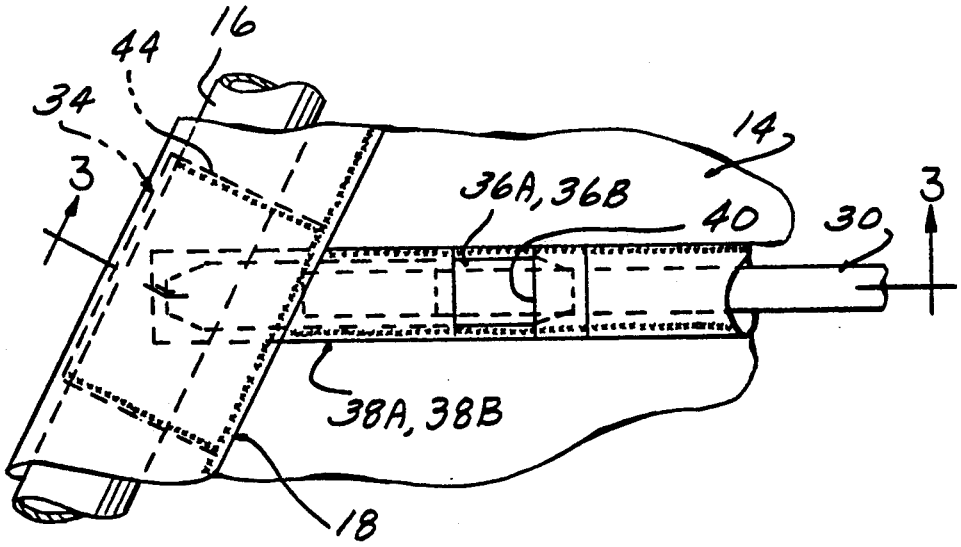
FIG. 2 is an enlarged fragmentary side view of the sail shaping arrangement associated with each batten of the sail of the sailboard side shown in FIG. 1.

FIG. 2 illustrates a typical sail shaping arrangement 34 associated with each batten 30, which includes a pair of flexible fingers 36A, 36B mounted opposite each other on opposite sides of the sail 14, together sandwiching the forward end of the associated batten 30. Since the flexible fingers 36A, 36B repeatedly undergo severe bending, they are constructed of a compliant material able to withstand bending without breaking.

Thin flat strips of stress relieved polypropylene plastic are suitable, 0.062 inch thick.

The flexible fingers may be removably mounted to the sail 14 by means of sewn in pockets 38A and 38B having openings 40 into which the respective flexible finger 36A or 36B can be inserted or removed.

The batten 30 and batten pocket 32 terminate at their forward end approximately at the rear seam 42 of the mast sleeve 18, while the flexible fingers 36A, 36B and pockets 38A, 38B extend forwardly thereof to extend over either side of the mast 16, straddling the same.

In order to insure that the flexible fingers 36A, 36B do straddle the mast 16 when the sail 14 is rigged, an inner guide sleeve 44 may be employed, disposed within the finger pockets 38A, 38B.

A thrust reinforcement pad (not shown) may be sewn over the end of the batten pocket 32.

Figure 3:
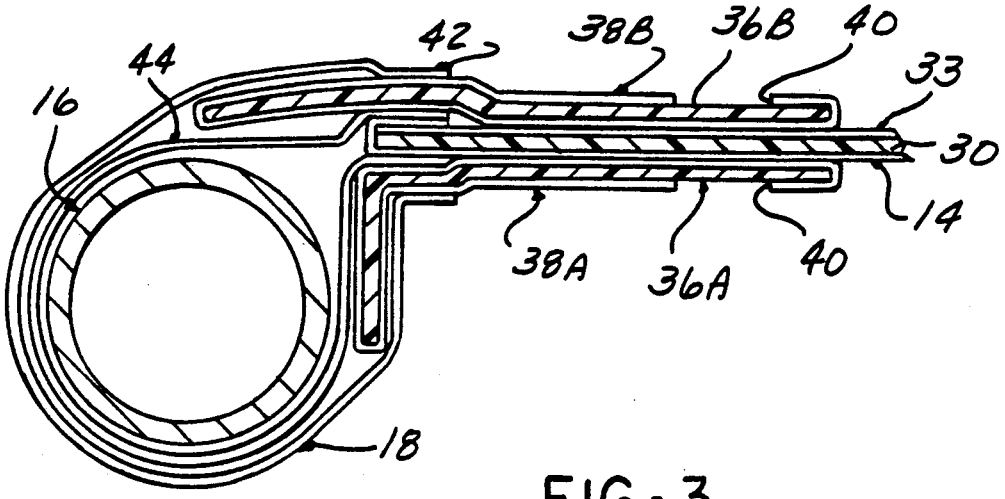
FIG. 3 is a transverse sectional view taken through the sail shaping arrangement shown in FIG. 2 along line 3—3 with the sail rotated to a fully filled out condition, but showing the various layers separated for clarity.

The flexible fingers 36A, 36B are constrained by being attached to the body of the sail 14 such that as the mast sleeve 18 rotates on the mast 16 as the sail 14 is filled out in tacking to either port or starboard, one end of the inside flexible finger, shown as 36A in FIG. 3, is bent over to form a knee, with one side thereof pushing against the mast 16 to thereby be restrained.

Figure 4:
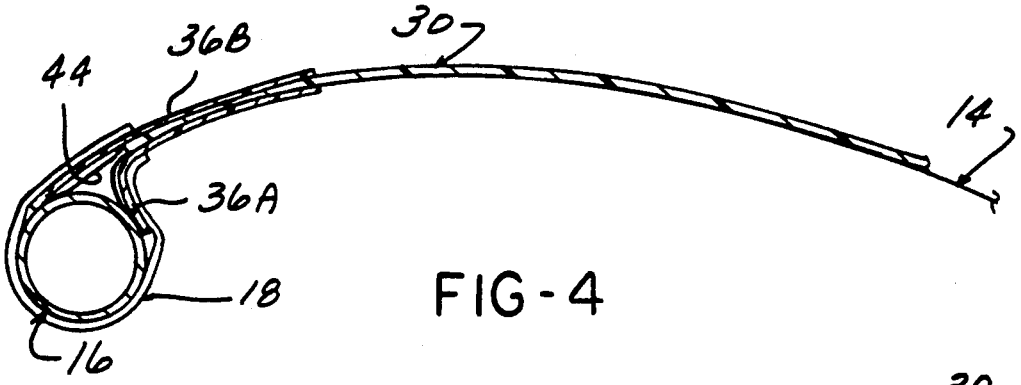
FIG. 4 is a simplified transverse sectional view depicting a sail and sail shaping arrangement in the filled out condition while tacking to port.

In the engaged condition illustrated in FIG. 4, the windward or inside finger 36A once bent to form a knee, is able to exert a force on the mast 16 by one side of the bent end being restrained by the mast 16, tending to resist reverse rotation, thus stabilizing the sail in this condition. The outside or leeward finger 36B simply overlies the mast 16 in a straightened condition, to act as a fairing piece.

The effect of the mast acting on the one side of the bent finger 36A resists forward movement of the batten 30, and the luff and outhaul tension prevents overrotation of the mast sleeve 18.

It will be appreciated that the bent finger 36A assumes a relatively stable locked condition, and cannot easily be restored to its straightened condition once bent, in as much as it acts as a one way clutch due to the directional nature of the engagement between the mast and finger. Thus, the mast sleeve is latched or stabilized in its proper rotative position in either direction corresponding to port or starboard tacks.

Figure 5:
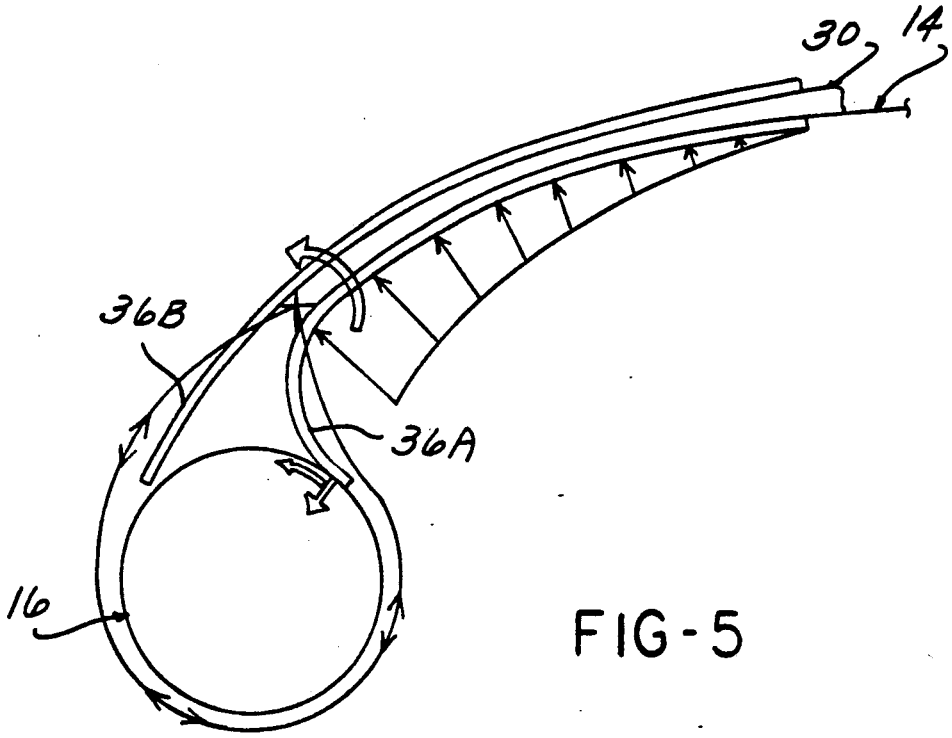
FIG. 5 is an enlarged diagrammatic transverse view of the major elements of the sail shaping arrangement according to the present invention, with a schematic indication of the forces generated with the arrangement in the latched condition.

FIG. 5 depicts diagrammatically the forces exerted in the stabilized end condition.

The finger 36A is frictionally prevented from shifting to windward, thus preventing rotation of the mast sleeve 18 to windward.

The folded finger 36A can only be straightened or restored by the substantial reverse movement of the boom in coming about or jibing, which causes the reversal of roles of the fingers 36A, 36B, finger 36B now being the windward finger, being bent to form a knee bearing against the mast 16.

Figure 6:
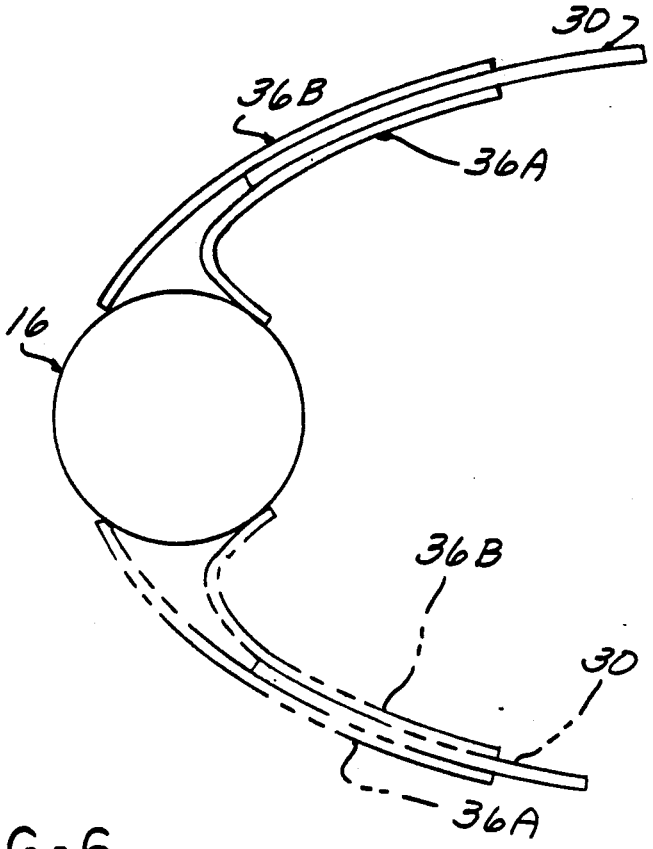
FIG. 6 is a transverse view of the elements shown in FIG. 5, with a phantom line depiction of the elements shifted to the opposite latched condition.

This reversal in conditions of the fingers 36A, 36B is illustrated in FIG. 6.

A second quite significant effect is also achieved by the sail shaping arrangement, in that a moment is generated by the forces applied to the batten 30 by the straight end of the folded finger 36A. This moment tends to increase the arch of the batten 30, thereby acting as a camber inducer increasing the camber of the sail 14. Since this moment is applied to all of the battens 30, the camber inducing forces are distributed along the height of the sail.

Figure 7:
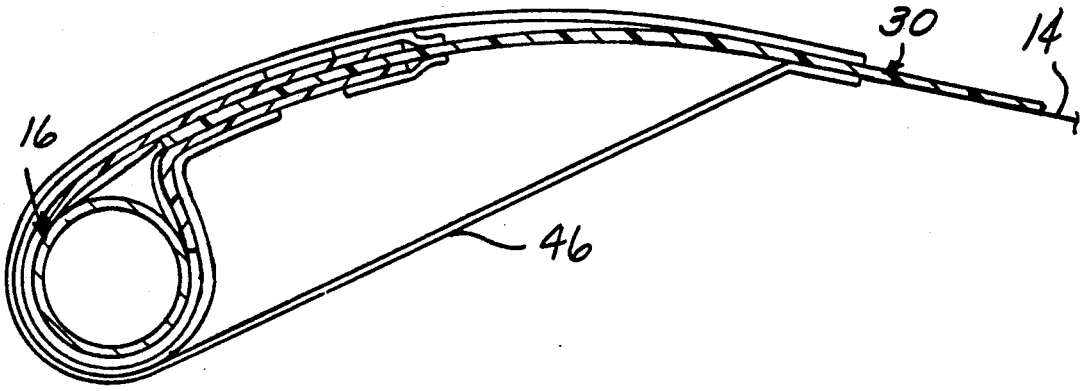
FIG. 7 is a simplified transverse sectional view of a modified version of the sail shaping arrangement according to the present invention.

FIG. 7 illustrates an extended fairing sleeve 46 added to the arrangement. Such sleeves have heretofore been known, and reduce the drag associated with the mast components.

Accordingly, a simple low cost sail shaping arrangement has been provided to achieve both sail shape stabilization and a camber inducing effect, without increasing the difficulty of rigging the sail, and which allows each batten to be raked and arched to contribute to the camber inducing effect.

We claim:

1. A sail shaping arrangement for a sailing craft of the type including a hull, a mast mounted to said hull, a sail of flexible sheet material mounted to said mast by means of a mast sleeve extending along the luff of said sail and a plurality of battens mounted to said sail to extend from the leech to the luff of said sail, said sail shaping arrangement comprising:

a pair of separate, flexible fingers which are normally straight and means mounting said fingers to said sail opposite each other and aligned with one of said battens, each of said fingers having one end extending past the forward tip of said batten to be coextensive with opposite sections of said mast sleeve so as to straddle said mast, the length of each of said fingers being sufficient so as to cause said one end of a respective inside one of said pair of flexible fingers to bend to form a knee therein upon shifting of said mast sleeve to a fully filled out condition on a respective side of said mast, said bent finger one end angled by said knee so that one side of said one end pushes directly against said mast so as to be restrained thereby from moving past said mast, said flexible fingers terminating before the midpoint of the mast said respective bent finger latches said mast sleeve in said either respective shifted position corresponding to said respective filled out condition of said sail, with said bent finger assuming a relatively stable locked condition pushed against said mast in either shifted position.

2. The sail shaping arrangement according to claim 1 further including additional pairs of flexible fingers, each additional pair associated with a respective other batten and means mounting each of said pair of flexible fingers to said sail opposite each other and aligned with one of said battens, each of said fingers having one end extending past the forward tip of said batten to be coextensive with opposite sections of said mast sleeve so as to straddle said mast, the length of each of said fingers in each additional pair being sufficient so as to cause said one end of a respective inside one of each of said additional pairs of flexible fingers to bend to form a knee therein upon shifting of said mast sleeve to a fully filled out condition on a respective side of said mast, said bent finger one end having one side reacting against said mast so as to be restrained thereby, whereby said respective bent finger in each of said additional pairs of flexible fingers tends to latch said mast sleeve in said either respective shifted position corresponding to said respective filled out condition of said sail.

3. The sail shaping arrangement according to claim 1 wherein said means mounting said flexible fingers to said sail comprises pockets attached to either side of said sail extending over said batten.

4. The sail shaping arrangement according to claim 1 wherein with said mast inclined back to said hull, said flexible fingers extend substantially parallel to said hull.

5. The sail shaping arrangement according to claim 1 wherein said sailing craft hull comprises a platform hull, said mast attached to said platform hull with a universal joint.

6. The sail shaping arrangement according to claim 1 further including a guide sleeve extending within said mast sleeve and said pair of flexible fingers to insure straddling of said mast by said flexible fingers upon rigging of said sail to said mast.

7. The sail shaping arrangement according to claim 1 wherein said pair of flexible fingers is constructed of thin flat strips of plastic.

8. The sail shaping arrangement according to claim 7 wherein said plastic comprises a stress relieved polypropylene.

9. In a sailing craft, a method of shaping the leading region of a sail rigged to a mast with a mast sleeve extending along the luff edge of said sail and receiving said mast therein, the method including the steps of attaching a pair of flexible fingers to said sail opposite each other on either side of a batten so that said fingers project forwardly to be coextensive with the trailing sides of said mast sleeve and to straddle said mast;

bending one end of a respective windward located flexible finger terminating rearward of the midpoint of said mast into a knee shape so as to assume a relatively stable locked condition with one side of the bent one end of said flexible finger pushing against said mast to thereby be restrained by said mast as said sail shifts to a filled out condition on a respective side of said mast by the forces generated by said knee of said bent finger acting on said mast and to induce camber by forces generated by said bent finger acting on said batten.

10. The method according to claim 9 further including the step of sewing a pocket on either side of said sail over said batten to attach said pair of flexible fingers to said sail.

* * * * *